US008428507B2

(12) United States Patent
Doyou

(10) Patent No.: US 8,428,507 B2
(45) Date of Patent: Apr. 23, 2013

(54) SHEET FEEDING DEVICE AND IMAGE FORMING APPARATUS HAVING THE SAME

(75) Inventor: Hideaki Doyou, Osaka (JP)

(73) Assignee: Kyocera Mita Corporation (JP)

( * ) Notice: Subject to any disclaimer, the term of this patent is extended or adjusted under 35 U.S.C. 154(b) by 489 days.

(21) Appl. No.: 12/727,621

(22) Filed: Mar. 19, 2010

(65) Prior Publication Data

US 2010/0247178 A1 Sep. 30, 2010

(30) Foreign Application Priority Data

Mar. 24, 2009 (JP) ..... 2009-072156
Oct. 6, 2009 (JP) ..... 2009-232300

(51) Int. Cl.
*G03G 15/14* (2006.01)

(52) U.S. Cl.
USPC ..... 399/396

(58) Field of Classification Search ..... 399/322, 399/396
See application file for complete search history.

(56) References Cited

U.S. PATENT DOCUMENTS

2006/0263129 A1* 11/2006 Won ..... 399/405

FOREIGN PATENT DOCUMENTS

JP 09-315600 12/1997

* cited by examiner

*Primary Examiner* — Walter L Lindsay, Jr.
*Assistant Examiner* — Barnabas Fekete
(74) *Attorney, Agent, or Firm* — Gerald E. Hespos; Michael J. Porco; Matthew T. Hespos

(57) ABSTRACT

A sheet feeding device includes a first conveying roller conveying the sheet, a second conveying roller conveying the sheet conveyed from the first conveying roller, a first driving gear having a first number of teeth, and a second driving gear having a second number of teeth. When a first meshing frequency defined by multiplication of the first number of teeth and the number of rotations of the first driving gear is defined as A, and a second meshing frequency defined by multiplication of the second number of teeth and the number of rotations of the second driving gear is defined as B, the first meshing frequency A and the second meshing frequency B are set so as to satisfy the following expression (1):A>B.

18 Claims, 3 Drawing Sheets

SHEET FEEDING DEVICE AND IMAGE FORMING APPARATUS HAVING THE SAME

BACKGROUND OF THE INVENTION

1. Field of the Invention

The present invention relates to a sheet feeding device for feeding a sheet to a predetermined target, and an image forming apparatus having the sheet feeding device.

2. Description of the Related Art

An image forming apparatus, such as a printer, copy machine and facsimile, has an image forming section for forming an image on a sheet and a sheet feeding device for feeding the sheet from a sheet storage section to the image forming section along a sheet conveying path. The sheet feeding device has a pair of sheet feeding rollers for sending the sheet to the sheet conveying path, and a pair of conveying rollers disposed on the downstream side of the sheet feeding rollers in the sheet conveying path and conveying the sheet to the further downstream side of the sheet conveying path.

It has been known that this sheet feeding device having the configuration mentioned above causes noise, so-called "paper slip noise." This noise occurs as follows. The sheet is conveyed while being stretched between the sheet feeding roller pair and the conveying roller pair by having one end of the sheet in a sheet conveying direction sandwiched between the pair of conveying rollers and the other end between the pair of sheet feeding rollers. When a vibration generated from the sheet feeding device propagates to the sheet while the sheet is conveyed in such a condition, the sheet vibrates. As a result, the paper slip noise occurs. The paper slip noise is unpleasant for a user.

A first technology has been known as the countermeasures for reducing the paper slip noise. In a sheet feeding device of the first technology, a roller that is capable of coming into contact with a sheet passing through a sheet feeding roller pair is provided on the downstream side of the sheet feeding roller pair in the sheet conveying direction. This roller prevents the abovementioned vibration by coming into contact with the vibrating paper. In this manner, the occurrence of the paper slip noise can be reduced.

The sheet feeding device of the first technology further includes a guide plate that is disposed along the sheet conveying path in the downstream of the sheet feeding roller pair in the sheet conveying direction, and a resonance chamber (so-called Helmholtz resonator) that has a predetermined space formed on the guide plate. The size of the Helmholtz resonator is set as to have a predetermined frequency characteristic corresponding to the frequency of the paper slip noise, in order to prevent the occurrence of the paper noise slip.

Although the sheet feeding device of the first technology reduces the occurrence of the paper slip noise by disposing the roller and the Helmholtz resonator along the sheet conveying path, the increase in the number of parts by adopting the roller and the Helmholtz resonator, the subsequent increase in the cost, and the complexity of the structure of the device are inevitable.

SUMMARY OF THE INVENTION

In view of the circumstances mentioned above, an object of the present invention is to provide a sheet feeding device, which is capable of reducing the paper slip noise while avoiding the increase in the number of parts, the subsequent increase in the cost and the complexity of the structure of the device, as well as an image forming apparatus having the sheet feeding device.

In order to achieve the object described above, a sheet feeding device according to one aspect of the present invention includes a sheet conveying path in which a sheet is conveyed in a predetermined direction, a first conveying roller disposed in the sheet conveying path and conveying the sheet in the predetermined direction, a second conveying roller disposed downstream of the first conveying roller in the sheet conveying path and conveying the sheet, conveyed from the first conveying roller, in the predetermined direction, a first driving gear attached coaxially to the first conveying roller for rotation therewith and having a first number of teeth, a second driving gear attached coaxially to the second conveying roller for rotation therewith and having a second number of teeth, and a drive source driving the first driving gear and the second driving gear. When a first meshing frequency defined by multiplication of the first number of teeth and the number of rotations of the first driving gear is defined as A, and a second meshing frequency defined by multiplication of the second number of teeth and the number of rotations of the second driving gear is defined as B, the first meshing frequency A and the second meshing frequency B are set so as to satisfy the following expression (1):

$$A>B \quad (1).$$

DETAILED DESCRIPTION OF THE PREFERRED EMBODIMENTS

An embodiment of the present invention is described hereinafter with reference to the drawings.

Figure 1:
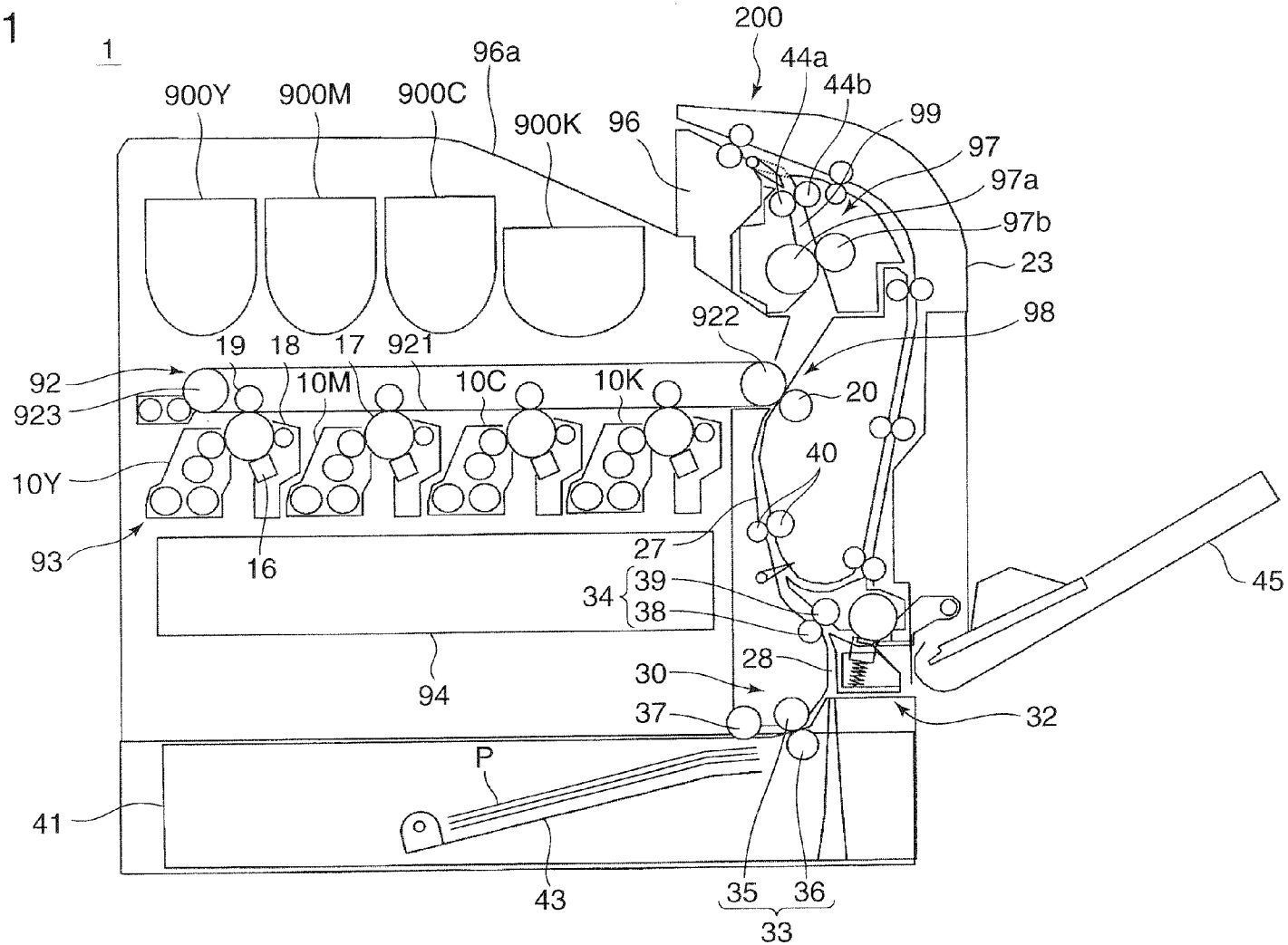
FIG. 1 is a cross-sectional diagram showing an internal structure of an image forming apparatus according to an embodiment.

FIG. 1 is a cross-sectional diagram showing an internal structure of an image forming apparatus according to the present embodiment. In the present embodiment, a color printer 1 is illustrated as an example of the image forming apparatus. The color printer 1 has an apparatus main body 200 that is connected to a personal computer (not shown) and the like directly or by a LAN.

As shown in FIG. 1, the apparatus main body 200 has an intermediate transfer unit 92, image forming unit 93, exposure unit 94, fixing device 97, and sheet discharge unit 96. The apparatus main body 200 further has a front cover 23, wherein a manual tray 45 for feeding a sheet manually is attached to the front surface of the front cover 23 so as to be pulled out.

The image forming unit 93 has a yellow toner container 900Y storing yellow toner, a magenta toner container 900M storing magenta toner, a cyan toner container 900C storing cyan toner, a black toner container 900K storing black toner, a yellow toner developing device 10Y receiving the yellow toner from the yellow toner container 900Y, a magenta toner developing device 10M receiving the magenta toner from the magenta toner container 900M, the cyan toner developing device 10C receiving the cyan toner from the cyan toner container 900C, a black toner developing device 10K receiving the black toner from the black toner container 900K, and four photosensitive drums 17 receiving the toner from the developing devices 10Y, 10M, 10C and 10K to form toner images. A photosensitive drum that uses an amorphous silicon-based (a-Si) material can be used as each of the photosensitive drums 17.

A charger 16, the corresponding developing device 10Y, 10M, 10C or 10K, a transfer roller 19, and a cleaner 18 are arranged around each photosensitive drum 17. The charger 16 charges the peripheral surface of the photosensitive drum 17 uniformly. The transfer roller 19 is disposed so as to face the photosensitive drum 17 to have an intermediate transfer belt 921 therebetween, and forms a nip portion with the photosensitive drum 17. The cleaner 18 cleans the peripheral surface of the photosensitive drum 17.

Below the image forming unit 93 is disposed the exposure unit 94. The exposure unit 94 has various optical elements, such as a light source, a polygon mirror, a reflecting mirror and a deflecting mirror, and emits light based on image data to the peripheral surface of the photosensitive drum 17.

The intermediate transfer unit 92 has the intermediate transfer belt 921, a driving roller 922, and a driven roller 923. The intermediate transfer belt 921 is stretched tightly between the driving roller 922 and the driven roller 923 while in contact with the peripheral surface of the photosensitive drum 17, and is rotated in a predetermined direction. The toner image is transferred primarily from each photosensitive drum 17 to the intermediate transfer belt 921 at the nip portion as the intermediate transfer belt 921 rotates.

Primary transfer of the toner image is carried out as follows. First of all, after the charger 16 charges the peripheral surface of the corresponding photosensitive drum 17, the exposure unit 94 exposes the peripheral surface with the light based on the image data to form an electrostatic latent image on the peripheral surface. Next, the developing device 10Y, 10M, 10C or 10K develops the electrostatic latent image to form a toner image on the peripheral surface of the corresponding photosensitive drum 17. At the nip portion, the toner image is transferred primarily from the peripheral surface of the photosensitive drum 17 onto the intermediate transfer belt 921. As a result, a color toner image is formed on the intermediate transfer belt 921. The cleaner 18 cleans the peripheral surface of the photosensitive drum 17 after the toner image is primarily transferred.

A secondary transfer roller 20 is disposed to face the driving roller 922 in contact therewith. A nip portion formed between the secondary transfer roller 20 and the driving roller 922 functions as a secondary transfer part 98. In the secondary transfer part 98, the color toner image on the intermediate transfer belt 921 is transferred secondarily onto a sheet (paper) P that is conveyed from a sheet cassette (sheet storage section) 41, which is described hereinafter. The sheet P subjected to the secondary transfer is conveyed to the fixing device 97. It is to be noted that the image forming unit 93, the intermediate transfer unit 92 and the secondary transfer roller 20 constitute an image forming section forming a toner image on a sheet conveyed from the sheet cassette 41.

The fixing device 97 carries out a fixing process on the toner images formed on the sheet P, and has a fixing roller 97*a* embedded with a heat source, and a pressing roller 97*b* that is disposed to face the fixing roller 97*a* in contact therewith a sheet discharge path 99 therebetween, and forms a fixing nip portion with the fixing roller 97*a*. The sheet P that is finished with the fixing process is conveyed toward the sheet discharge unit 96 via the sheet discharge path 99 by a pair of discharging rollers 44*a*, 44*b* that is disposed on the downstream side of the fixing roller 97*a* and the pressing roller 97*b* in the fixing device 97. The sheet discharge unit 96 is formed in an upper part of the apparatus main body 200. The sheet discharge unit 96 discharges the sheet P, which conveyed from the fixing device 97, onto a sheet discharge tray 96*a* from on an upper surface of the apparatus main body 200. Note that the sheet discharge path 99 extends from the fixing nip portion to the sheet discharge unit 96.

The sheet P that is subjected to the secondary transfer in the secondary transfer part 98 is conveyed to the secondary transfer part 98 by a sheet feeding device 30. The sheet feeding device 30 is now described hereinafter in detail.

The sheet feeding device 30 has the sheet cassette 41 disposed below the exposure unit 94 and storing the sheet P, and a sheet conveying path 27 that extends from the sheet cassette 41 to the fixing device 97 and conveys the sheet P from the sheet cassette 41 to the secondary transfer part 98. The sheet cassette 41 has a sheet placing surface 43 on which a stack of sheets is placed.

The sheet feeding device 30 further has a group of rollers disposed on the sheet conveying path 27. This roller group is configured by a pickup roller 37, first conveying roller pair 33, second conveying roller pair 34, and resist roller pair 40, which are disposed sequentially from the upstream side toward the downstream side in a sheet conveying direction T (FIG. 2) in which the sheet P is carried from the sheet cassette 41 toward the secondary transfer part 98.

The pickup roller 37 disposed above the sheet placing surface 43 takes sheets P, one by one, from the stack of sheet on the sheet placing surface 43 and conveys the sheet P to the first conveying roller pair 33. The first conveying roller pair 33 conveys the sheet P from the pickup roller 37 to the second conveying roller pair 34 disposed further downstream. The sheet conveying path 27 has a curved conveying part 28 that is curved between the first conveying roller pair 33 and the second conveying roller pair 34. The curved conveying part 28 curves while extending upward from the first conveying roller pair 33 toward the second conveying roller pair 34. When the sheet P is conveyed from the first conveying roller pair 33 to the second conveying roller pair 34, the sheet P is curved along the curved shape of the curved conveying part 28.

The second conveying roller pair 34 conveys the sheet P, which is conveyed from the first conveying roller pair 33, to the resist roller pair 40 positioned further downstream. The resist roller pair 40 not only conveys the sheet P to the secondary transfer part 98 at an appropriate timing, but also corrects skew feeding of the sheet P.

The second conveying roller pair 34 conveys not only the sheet P from the sheet cassette 41 to the resist roller pair 40, but also a sheet, which is placed on the manual tray 45 and conveyed by a manual sheet feeding device 32, to the resist roller pair 40.

Figure 2:
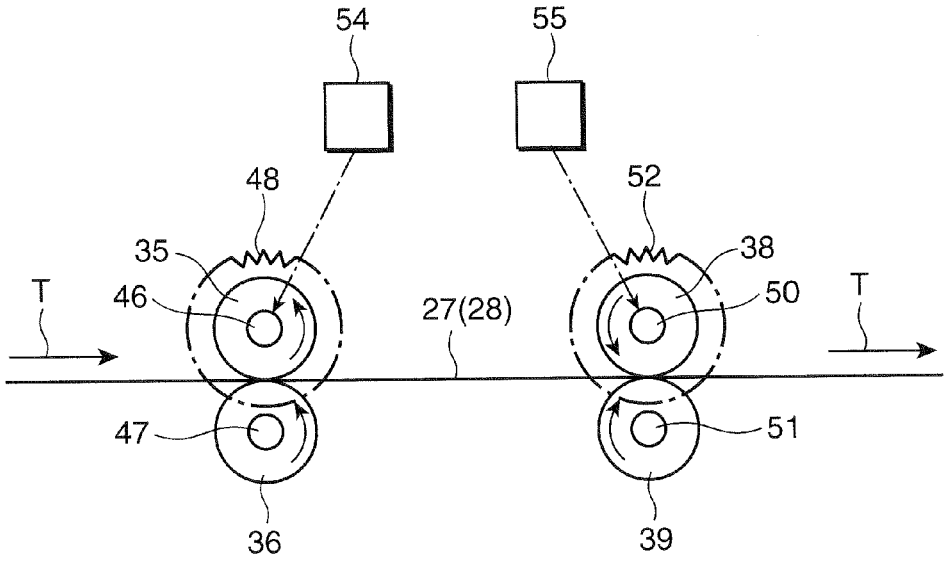
FIG. 2 is a diagram schematically showing a first conveying roller pair and second conveying roller pair of a sheet feeding device.

FIG. 2 is a diagram schematically showing the first conveying roller pair 33 and the second conveying roller pair 34 in the sheet conveying path 27. The sheet feeding device 30 further has a pair of first driving rotary shaft 46 and opposed driving rotary shaft 47, which extends in a direction substantially perpendicular to the sheet conveying direction T, and a pair of second driving rotary shaft 50 and driven rotary shaft 51, which is disposed on the downstream side of the pair of first driving rotary shaft 46 and opposed driving rotary shaft 47 and extends in a direction substantially perpendicular to the sheet conveying direction T.

The first conveying roller pair 33 is configured by a sheet feeding roller 35, which is attached to the first driving rotary shaft 46 so as to be rotatable coaxially and integrally therewith, and a retard roller 36, which is attached to the opposed driving rotary shaft 47 so as to be rotatable coaxially and integrally therewith and is disposed to face the sheet feeding roller 35 in contact therewith. The sheet feeding roller 35 conveys the sheets P, which are conveyed one by one from the pickup roller 37, toward the second conveying roller pair 34 on the downstream side while rotating counterclockwise as shown by the arrow. The retard roller 36, on the other hand, is a roller for preventing double-feed of the sheets P when the multiple sheets P are fed from the pickup roller 37. The retard roller 36 prevents double-feed of the sheets P by coming into contact with the sheets P positioned on the side of the retard roller 36, while rotating counterclockwise as shown by the arrow, that is, by rotating in the same rotation direction as the rotation direction of the sheet feeding roller 35. Specifically, the frictional force between the double-fed sheets P is smaller than the frictional force between the retard roller 36 and the sheets P on the retard roller 36 side, thus double-feed of the sheets P is reduced.

The sheet feeding device 30 further has a first driving gear 48 that is attached to the first driving rotary shaft 46 so as to be rotatable coaxially (coaxially with the sheet feeding roller 35) and integrally therewith. The first driving gear 48 is coupled to an output shaft of a first drive source 54 (e.g., a motor) via another unshown gear and rotated by the driving force of the motor. The first driving rotary shaft 46 rotates as the first driving gear 48 rotates, and, as a result, the sheet feeding roller 35 rotates counterclockwise. Furthermore, the retard roller 36 is rotated counterclockwise by an unshown drive source different than the first drive source 54.

The second conveying roller pair 34 is configured by a driving conveying roller 38, which is attached to the second driving rotary shaft 50 so as to be rotatable coaxially and integrally therewith, and a driven conveying roller 39, which is attached to the driven rotary shaft 51 so as to be rotatable coaxially and integrally therewith and is disposed to face the driving conveying roller 38 in contact therewith. The driving conveying roller 38 rotates counterclockwise, as shown by the arrow, while the driven conveying roller 39 rotates clockwise, as shown by the arrow. Therefore, the sheet P conveyed from the first conveying roller pair 33 is conveyed toward the resist roller pair 40 (FIG. 1).

The sheet feeding device 30 further has a second driving gear 52, which is attached to the second driving rotary shaft 50 so as to be rotatable coaxially (coaxially with the driving conveying roller 38) and integrally therewith. The second driving gear 52 is coupled to an output shaft of a second drive source 55 (e.g., a motor) via another unshown gear and rotated by the driving force of the motor. The second driving rotary shaft 50 rotates as the second driving gear 52 rotates, and, as a result, the driving conveying roller 38 rotates counterclockwise. Consequently, the driven conveying roller 39 is driven to rotate clockwise. Note that the first driving gear 48 and the second driving gear 52 may be driven by the same drive source via a gear mechanism.

The first driving gear 48 has the predetermined number of teeth (the first number of teeth) N1 and is rotated at the predetermined number of rotations R1 by the first drive source 54. The first driving gear 48 also has a first meshing frequency A that is defined by multiplication of the teeth number N1 and the rotation number R1 (N1×R1). The second driving gear 52, on the other hand, has the predetermined number of teeth (second number of teeth) N2 and is rotated at the predetermined number of rotations R2 by the second drive source 55. The second driving gear 52 also has a second meshing frequency B that is defined by multiplication of the teeth number N2 and the rotation number R2 (N2×R2).

Each of the sheet feeding roller 35 and the driving conveying roller 38 has slidability to the sheet P under the same condition, for example, when conveying the same sheet P at the same number of rotations. The slidability of the sheet feeding roller 35 when conveying the sheet P is defined by, for example, the distance in which the sheet P can be conveyed by a single rotation of the sheet feeding roller 35. The slidability of the driving conveying roller 38 when conveying the sheet P is defined by the distance in which the sheet P can be conveyed by a single rotation of the driving conveying roller 38. The slidability of the sheet feeding roller 35 and of the driving conveying roller 38 is affected by, for example, the materials of the roller surfaces or the number of rotations of the sheet feeding roller 35 and the driving conveying roller 38.

In the sheet feeding device 30 having the configuration described above, when the sheet P is conveyed such that one end thereof on the downstream side of the sheet conveying direction T is sandwiched by the first conveying roller pair 33 and the other end on the upstream side of the sheet conveying direction T is sandwiched by the second conveying roller pair 34, the vibration of the first driving gear 48 propagates to the sheet P through the sheet feeding roller 35, and at the same time the vibration of the second driving gear 52 propagates to the sheet P through the driving conveying roller 38. Consequently, the sheet P vibrates, causing paper slip noise, which is unpleasant for a user.

However, the paper slip noise can be reduced by setting the first meshing frequency A of the first driving gear 48 and the second meshing frequency B of the second driving gear 52 so as to satisfy the following expression (1):

$$A>B \tag{1}$$

Specifically, by setting the meshing frequency A and the meshing frequency B to satisfy the above expression (1), the vibration propagating from the first driving gear 48 to the sheet P via the sheet feeding roller 35 and the vibration propagating from the second driving gear 52 to the sheet P via the driving conveying roller 38 can be balanced. As a result, the paper slip noise of the sheet P caused by the vibrations of the first driving gear 48 and the second driving gear 52 can be reduced.

Particularly, as shown in FIG. 1, when the section between the first conveying roller pair 33 and the second conveying roller pair 34 in the sheet conveying path 27 is curved, that is, when the curved conveying part 28 is formed, satisfying the above expression (1) can reduce the occurrence of the paper slip noise in the curved conveying part 28, the paper slip noise being caused by the vibration of the sheet P as it passes through the curved conveying part 28.

More specifically, in the curved conveying part 28, because the sheet P is conveyed while being curved along the curved shape of the curved conveying part 28, the sheet P can be bent easily in the curved conveying part 28, depending on the type of the sheet. The vibrations of the first driving gear 48 and the second driving gear 52 can easily propagate to the bent sheet P, and consequently the paper slip noise is magnified. In the sheet feeding device 30 of the present embodiment, however, because the expression (1) above is satisfied, the paper slip noise can be reduced from occurring, even when the sheet P is bent, that is, even when the sheet conveying path 27 is curved.

In addition, even when the slidability of the sheet feeding roller 35 is different from the slidability of the driving conveying roller 38, that is, even when the slidability of the driving conveying roller 38 during the conveyance of the sheet P is greater than the slidability of the sheet feeding roller 35 during the conveyance of the sheet P provided the same sheet P is conveyed under the same condition, the occurrence of the paper slip noise can be reduced.

When the slidability of the driving conveying roller 38 is greater than the slidability of the sheet feeing roller 35, the sheet P is stretched by the driving conveying roller 38 and thereby tightly stretched between the first conveying roller pair 33 and the second conveying roller pair 34. In such a condition, the vibrations of the first driving gear 48 and the second driving gear 52 easily propagate to the sheet P, magnifying the paper slip noise. In the sheet feeding device 30 of the present embodiment, however, because the expression (1) above is satisfied, the occurrence of the paper slip noise can be reduced, even when the sheet P is stretched, that is, even when the slidability of the conveying roller on the downstream side is greater than the slidability of the conveying roller on the upstream side.

As described above, in the sheet feeding device 30 according to the present embodiment, the paper slip noise of the sheet P caused by the vibrations of the first driving gear 48 and the second driving gear 52 is reduced by satisfying the expression (1) without providing an additional special member for reducing the generation of the vibrations. Therefore, the increase in the number of parts, the subsequent increase in the cost, and the complexity of the structure of the device can be avoided.

In the embodiment described above, the occurrence of the paper slip noise of the sheet P can further be reduced by defining a relationship between an outer diameter of the sheet feeding roller 35 and an outer diameter of the driving conveying roller 38, in addition to the expression (1). In a more preferred embodiment, the outer diameter of the sheet feeding roller 35 is defined as DA, and the outer diameter of the driving conveying roller 38 is defined as DB. The outer diameter DA and the outer diameter DB are set so as to satisfy the following expression (2):

$$DA>DB \tag{2}$$

Figure 3:
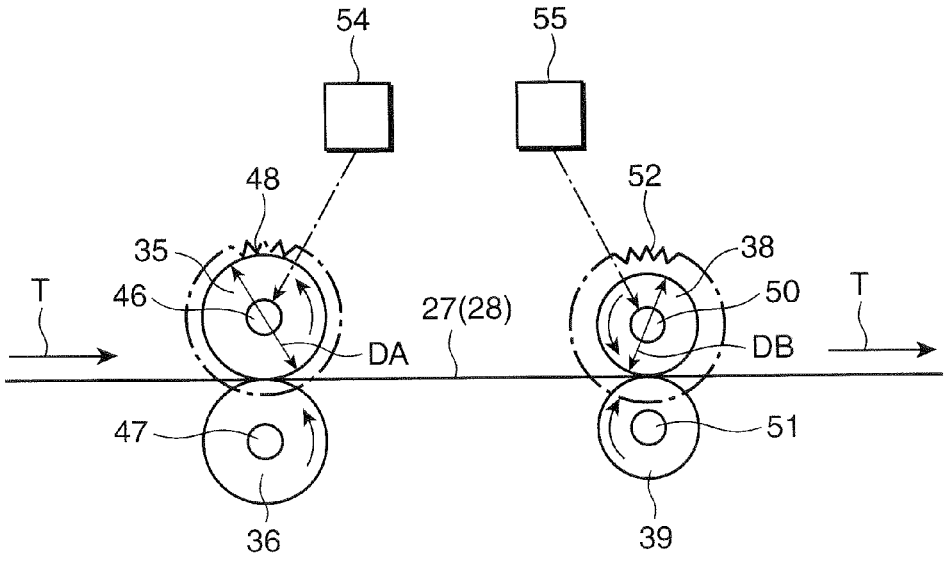
FIG. 3 is a diagram schematically showing the first conveying roller pair and second conveying roller pair of the sheet feeding device.

In other words, the occurrence of the paper slip noise of the sheet P can be further reduced by making the outer diameter DA of the sheet feeding roller 35 larger than the outer diameter DB of the driving conveying roller 38, as shown in FIG. 3.

Moreover, in the present embodiment, by defining the relationship between the slip ratio of the retard roller 36 to the sheet P and the slip ratio of the driven conveying roller 39 to the sheet P, the paper slip noise of the sheet P can further be reduced. In this case, a driven roller that rotates as the sheet feeding roller 35 rotates ("first driven roller 56" hereinafter) is disposed in place of the retard roller 36, and a driven rotary shaft 67 that supports the driven roller 56 such that the driven roller 56 can be driven and rotated is disposed in place of the opposed driving rotary shaft 47.

Figure 4:
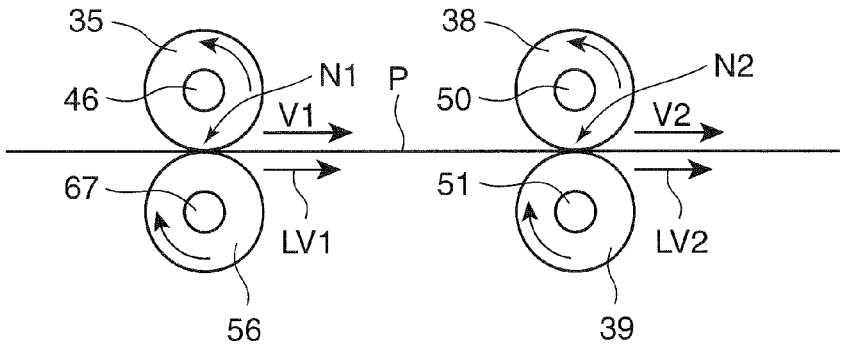
FIG. 4 is a diagram schematically showing the first conveying roller pair and second conveying roller pair of the sheet feeding device.

Specifically, as shown in FIG. 4, a first nip portion N1, which sandwiches the sheet P to be conveyed, is formed between the sheet feeding roller 35 and the first driven roller 56. When the sheet P is conveyed from the pickup roller 37 to the first nip portion N1, the sheet feeding roller (first driving roller) 35 sends the sheet P to the driving conveying roller (second driving roller) 38 on the downstream side while rotating in a predetermined direction (counterclockwise in FIG. 4). At this moment, the first driven roller 56 is driven to rotate clockwise by the frictional force acting between the sheet P conveyed to the downstream side by the sheet feeding roller 35 and the peripheral surface of the first driven roller 56. However, because a first conveyance speed V1 of the sheet P conveyed by the sheet feeding roller 35 at the first nip portion N1 is higher than a first rotational linear speed LV1 of the first driven roller 56 at the first nip portion N1 (that is, the rotational linear speed obtained from the frictional force of the sheet P), the driven rotation of the first driven roller cannot keep up with the sheet P conveyed at the first conveyance speed V1, whereby the first driven roller 56 easily runs idle relative to the sheet P.

Furthermore, a second nip portion N2 that sandwiches the sheet P to be conveyed by the sheet feeding roller 35 is formed between the driving conveying roller 38 and the driven conveying roller (second driven roller) 39. When the sheet P is conveyed to the second nip portion N2, the driving conveying roller 38 sends the sheet P to the resist roller pair 40 on the downstream side while rotating in a predetermined direction (counterclockwise in FIG. 4). At this moment, the driven conveying roller 39 is driven to rotate clockwise by the frictional force acting between the sheet P conveyed to the downstream side by the driving conveying roller 38 and the peripheral surface of the driven conveying roller 39. However, because a second conveyance speed V2 of the sheet P conveyed by the driving conveying roller 38 at the second nip portion N2 is higher than a second rotational linear speed LV2 of the driven conveying roller 39 at the second nip portion N2, the driven rotation of the driven conveying roller 39 cannot keep up with the sheet P conveyed at the second conveyance speed V2, whereby the driven conveying roller 39 easily runs idle relative to the sheet P.

The idle running of the first driven roller 56 and the driven conveying roller 39 relative to the sheet P is considered to worsen the paper slip noise of the sheet P. Therefore, in a more preferred embodiment, a first slip ratio defined by the ratio between the first rotational linear speed LV1 of the first driven roller 56 and the first conveyance speed V1 of the sheet P (LV1/V1) is defined as SA, and a second slip ratio defined by the ratio between the second rotational linear speed LV2 of the driven conveying roller 39 and the second conveyance speed V2 of the sheet P (LV2/V2) is defined as SB. Then, the first slip ratio SA and the second slip ratio SB are set so as to satisfy the following expression (3), whereby the paper slip noise of the sheet P can be suppressed.

$$SA<SB \tag{3}$$

In other words, it has been found that the occurrence of the paper lip noise of the sheet P can be reduced by setting the first slip ratio SA to be smaller than the second slip ratio SB. The first slip ratio SA and the second slip ratio SB are set by, for example, appropriately selecting the materials for the roller surfaces of the first driven roller 56 and the driven conveying roller 39 and causing the frictional force to act between the sheet P and the first driven roller 56 or the driven roller 39.

The above has described the expressions (1) to (3) as the conditions for reducing the paper slip noise of the sheet P. However, all of the expressions (1) to (3) do not have to be satisfied, and either one of the expressions (2) and (3) may be satisfied after satisfying the expression (1). It goes without saying that the paper slip noise of the sheet P is reduced to the maximum extent by satisfying all of the expressions (1) to (3).

The embodiment above has described that in the sheet feeding device 30 for conveying the sheet P to the secondary transfer part 98, the expression (1) is applied to the sheet feeding roller 35, which is the upstream side conveying roller, and to the driving conveying roller 38, which is the downstream side conveying roller. However, the expression (1) can be applied to not only the sheet feeding roller 35 and the driving conveying roller 38 of the sheet feeding device 30 but also another group of rollers of the image forming apparatus 1.

Figure 5:
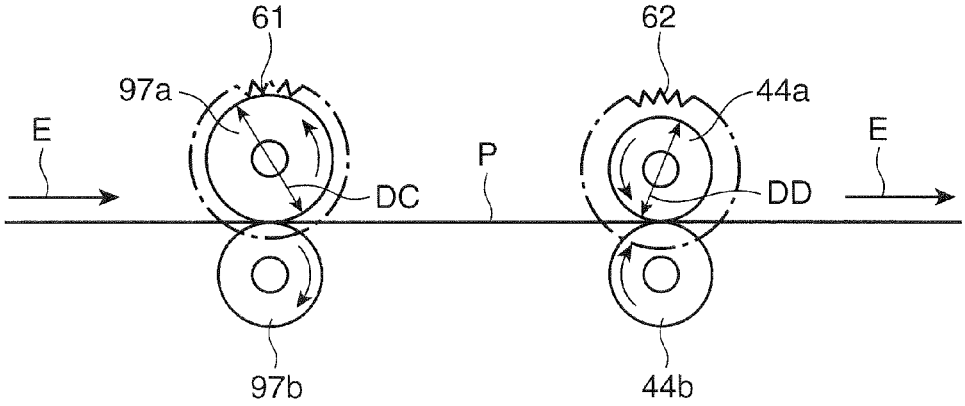
FIG. 5 is a diagram schematically showing a group of rollers of a fixing device.

FIG. 5 is a schematic diagram of the fixing device to which the expression (1) is applied. In the fixing device 97, the fixing roller 97*a* and the pressing roller 97*b* perform the fixing process on the toner images on the sheet P while conveying the sheet P along the sheet discharge path 99 in a sheet discharge direction E. The sheet P that is subjected to the fixing process is conveyed to the sheet discharge unit 96 through the sheet discharge path 99 by the pair of discharging rollers 44*a*, 44*b*. In the fixing device 97, therefore, the fixing roller 97*a* and the pressing roller 97*b* configure an upstream side conveying roller pair, and the pair of discharging rollers 44*a*, 44*b* configures a downstream side conveying roller pair. When the sheet P passes through the fixing device 97, one end of the sheet P is sandwiched (nipped) between the fixing roller 97*a* and the pressing roller 97*b*, while the other end is sandwiched by the discharging roller pair 44. Therefore, the sheet P is tightly stretched. In some cases the sheet P vibrates due to the vibrations from a fixing roller side driving gear 61 and discharging roller side driving gear 62 that are attached to the fixing roller 97*a* and the discharging roller 44*a* respectively, whereby the paper slip noise is generated. Note that the fixing roller side driving gear 61 is a gear that is attached to the fixing roller 97*a* so as to be rotatable coaxially and integrally therewith and has the first number of teeth. The discharging roller side driving gear 62 is a gear that is attached to the fixing roller 44*a* so as to be rotatable coaxially and integrally therewith and has the second number of teeth.

A first meshing frequency defined by multiplication of the first teeth number and the number of rotations of the fixing roller side driving gear 61 is defined as F1, and a second meshing frequency defined by multiplication of the second teeth number and the number of rotations of the discharging roller side driving gear 62 is defined as F2. The first meshing frequency F1 and the second meshing frequency F2 are set so as to satisfy the following expression (4), whereby the occurrence of the paper slip noise of the sheet P in the fixing device 97 can be reduced.

$$F1>F2 \quad (4)$$

In addition to the expression (4), the relationship between an outer diameter of the fixing roller 97*a* and an outer diameter of the discharging roller 44*a* can be defined to further reduce the occurrence of the paper slip noise of the sheet P. The outer diameter of the fixing roller 97*a* is defined as DC, and the outer diameter of the discharging roller 44*a* is defined as DD. The outer diameter DC and the outer diameter DD are set so as to satisfy the following expression (5).

$$DC>DD \quad (5)$$

In other words, it has been found that the occurrence of the paper slip noise of the sheet P can be further reduced by making the outer diameter DC of the fixing roller 97*a* larger than the outer diameter DD of the discharging roller 44*a*.

The embodiment above has explained the example in which the first driving gear 48 and the second driving gear are driven by meshing with each other, but the first driving gear 48 and the second driving gear 52 may be driven by, for example, pulleys with internal teeth.

The image forming apparatus according to the present embodiment, particularly the sheet feeding device used in the image forming apparatus, preferably has the following configuration.

The sheet feeding device preferably includes a sheet conveying path in which a sheet is conveyed in a predetermined direction, a first conveying roller disposed in the sheet conveying path and conveying the sheet in the predetermined direction, a second conveying roller disposed downstream of the first conveying roller in the sheet conveying path and conveying the sheet, conveyed from the first conveying roller, in the predetermined direction, a first driving gear attached coaxially to the first conveying roller for rotation therewith and having a first number of teeth, a second driving gear attached coaxially to the second conveying roller for rotation therewith and having a second number of teeth, and a drive source driving the first driving gear and the second driving gear. When a first meshing frequency defined by multiplication of the first number of teeth and the number of rotations of the first driving gear is defined as A, and a second meshing frequency defined by multiplication of the second number of teeth and the number of rotations of the second driving gear is defined as B, the first meshing frequency A and the second meshing frequency B are set so as to satisfy the following expression (1):

$$A>B \quad (1).$$

According to the sheet feeding device with the abovementioned configuration, by setting the meshing frequency A and the meshing frequency B to satisfy the above expression (1), the vibration propagating from the first driving gear to the sheet via the first conveying roller and the vibration propagating from the second driving gear to the sheet via the second conveying roller can be balanced. As a result, the paper slip noise of the sheet caused by the vibrations of the first driving gear and the second driving gear can be reduced from occurring.

In the fixing device with the abovementioned configuration, preferably, when the outer diameter of the first conveying roller is defined as DA and the outer diameter of the second conveying roller as DB, the outer diameters DA and DB are set so as to satisfy the following expression (2):

$$DA>DB \quad (2)$$

In addition, in the fixing device with the abovementioned configuration, preferably, the first conveying roller includes a first driving roller conveying the sheet in the predetermined direction, and a first driven roller that is disposed to face the first driving roller so as to sandwich the sheet therebetween and is driven to rotate due to the sheet conveyance by the first driving roller. The second conveying roller also includes a second driving roller conveying the sheet, conveyed from the first driving roller, in the predetermined direction, and a second driven roller that is disposed to face the second driving roller so as to sandwich the sheet therebetween and is driven to rotate due to the sheet conveyance by the second driving roller. When a first slip ratio, defined by a ratio between a rotational linear speed obtained when the first driven roller is driven to rotate and a conveyance speed of the sheet at a position of the first driven roller, is defined as SA, and a second slip ratio, defined by a ratio between a rotational linear speed obtained when the second driven roller is driven to rotate and a conveyance speed of the sheet at a position of the second driven roller, is defined as SB, the first slip ratio SA and the second slip ratio SB are set so as to satisfy the following expression (3):

$$SA<SB \quad (3).$$

In the configuration above, it has been found that the occurrence of the paper slip noise of the sheet can further be reduced by satisfying both or either one of the expressions (2) and (3) after satisfying the expression (1).

In the fixing device with the configuration above, preferably, the sheet conveying path has a curved conveying part that is curved between the first conveying roller and the second conveying roller.

When passing through the curved conveying part of the sheet conveying path, the sheet is conveyed while being curved along the curved shape of the curved conveying part. Therefore, the sheet can be distorted easily in the curved conveying part, depending on the type of the sheet. The vibrations of the first driving gear and the second driving gear can easily propagate to the distorted sheet, and consequently the paper slip noise is magnified. In the sheet feeding device of the present invention, however, because at least the expression (1) above is satisfied, the paper slip noise can be reduced from occurring, even when the sheet is distorted.

Furthermore, in the fixing device with the configuration above, preferably slidability of the second conveying roller during the sheet conveyance is greater than slidability of the first conveying roller during the sheet conveyance, when the same sheet is conveyed under same conditions.

When the slidability of the second conveying roller is greater than the slidability of the first conveying roller, the sheet is stretched by the second conveying roller and thereby tightly stretched between the first conveying roller and the second conveying roller. In such a condition, the vibrations of the first driving gear and the second driving gear easily propagate to the sheet, magnifying the paper slip noise. In the sheet feeding device of the present invention, however, because at least the expression (1) above is satisfied, the occurrence of the paper slip noise can be reduced even when the sheet is stretched.

In the fixing device with the configuration above, it is preferable that: the sheet feeding device further includes a sheet storage section storing the sheet and a pickup roller feeding the sheet from the sheet storage section to the first conveying roller, that the first conveying roller includes a sheet feeding roller conveying the sheet, conveyed from the pickup roller, to the second conveying roller, and a retard roller that is disposed to face the sheet feeding roller in contact therewith and rotates in the same rotation direction as a rotation direction of the sheet feeding roller to prevent sheet double-feeding, and that the first driving gear is attached coaxially to the sheet feeding roller for rotation therewith.

According to this configuration, because the vibration from the first driving gear propagates to the sheet via the sheet feeding roller and at least the expression (1) is satisfied, the paper slip noise caused by the vibration can be reduced.

This application is based on Japanese Patent application serial Nos. 2009-072156 and 2009-232300 filed in Japan Patent Office on Mar. 24, 2009 and Oct. 6, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeding device, comprising:

a sheet conveying path in which a sheet is conveyed in a predetermined direction;

a first conveying roller pair having a first conveying roller disposed in the sheet conveying path and conveying the sheet in the predetermined direction;

a second conveying roller pair having a second conveying roller disposed downstream of the first conveying roller in the sheet conveying path and conveying the sheet, conveyed from the first conveying roller, in the predetermined direction;

a first driving gear attached coaxially to the first conveying roller for rotation therewith and having a first number of teeth;

a second driving gear attached coaxially to the second conveying roller for rotation therewith and having a second number of teeth; and a drive source driving the first driving gear and the second driving gear, wherein, when an end of the sheet on an upstream side in the predetermined direction is sandwiched by the first conveying roller pair and an end of the sheet on a downstream side in the predetermined direction is sandwiched by the second conveying roller pair, the expression A>B is satisfied, where A is a first meshing frequency defined by multiplication of the first number of teeth and the number of rotations of the first driving gear and B is a second meshing frequency defined by multiplication of the second number of teeth and the number of rotations of the second driving gear.

2. The sheet feeding device according to claim 1, wherein when an outer diameter of the first conveying roller is defined as DA and an outer diameter of the second conveying roller as DB, the outer diameters DA and DB are set so as to satisfy the following expression (2):

$$DA>DB \quad (2).$$

3. The sheet feeding device according to claim 1, wherein the first conveying roller includes a first driving roller conveying the sheet in the predetermined direction, and a first driven roller that is disposed to face the first driving roller so as to sandwich the sheet therebetween and is driven to rotate due to the sheet conveyance by the first driving roller, the second conveying roller includes a second driving roller conveying the sheet, conveyed from the first driving roller, in the predetermined direction, and a second driven roller that is disposed to face the second driving roller so as to sandwich the sheet therebetween and is driven to rotate due to the sheet conveyance by the second driving roller, and when a first slip ratio, defined by a ratio between a rotational linear speed obtained when the first driven roller is driven to rotate and a conveyance speed of the sheet at a position of the first driven roller, is defined as SA, and a second slip ratio, defined by a ratio between a rotational linear speed obtained when the second driven roller is driven to rotate and a conveyance speed of the sheet at a position of the second driven roller, is defined as SB, the first slip ratio SA and the second slip ratio SB are set so as to satisfy the following expression (3):

$$SA<SB \quad (3).$$

4. The sheet feeding device according to claim 2, wherein the first conveying roller includes a first driving roller having the outer diameter DA and conveying the sheet in the predetermined direction, and a first driven roller that is disposed to face the first driving roller so as to sandwich the sheet therebetween and is driven to rotate due to the sheet conveyance by the first driving roller, the second conveying roller includes a second driving roller having the outer diameter DB and conveying the sheet, conveyed from the first driving roller, in the predetermined direction, and a second driven roller that is disposed to face the second driving roller so as to sandwich the sheet therebetween and is driven to rotate due to the sheet conveyance by the second driving roller, and when a first slip ratio, defined by a ratio between a rotational linear speed obtained when the first driven roller is driven to rotate and a conveyance speed of the sheet at a position of the first driven roller, is defined as SA, and a second slip ratio, defined by a ratio between a rotational linear speed obtained when the second driven roller is driven to rotate and a conveyance speed of the sheet at a position of the second driven roller, is defined as SB, the first slip ratio SA and the second slip ratio SB are set so as to satisfy the following expression (3):

$$SA<SB \quad (3).$$

5. The sheet feeding device according to claim 1, wherein the sheet conveying path has a curved conveying part that is curved between the first conveying roller and the second conveying roller.

6. The sheet feeding device according to claim 1, wherein slidability of the second conveying roller during the sheet conveyance is greater than slidability of the first conveying roller during the sheet conveyance, when the same sheet is conveyed under same conditions.

7. The sheet feeding device according to claim 1, further comprising:

a sheet storage section storing the sheet; and a pickup roller feeding the sheet from the sheet storage section to the first conveying roller, wherein the first conveying roller includes a sheet feeding roller conveying the sheet, conveyed from the pickup roller, to the second conveying roller, and a retard roller that is disposed to face the sheet feeding roller in contact therewith and rotates in the same rotation direction as a rotation direction of the sheet feeding roller to prevent sheet double-feeding, and the first driving gear is attached coaxially to the sheet feeding roller for rotation therewith.

8. A fixing device, comprising:

a sheet discharge path in which a sheet is discharged in a predetermined direction;

a fixing roller disposed in the sheet discharge path and performing fixation to a toner image on the sheet;

a pressing roller disposed to face the fixing roller in contact therewith with the sheet discharge path therebetween and forming a fixing nip portion with the fixing roller;

a discharging roller disposed downstream of the fixing roller in the sheet discharge path and discharging the sheet, subjected to the fixation, in the predetermined direction;

a fixing roller side driving gear attached coaxially to the fixing roller for rotation therewith and having a first number of teeth; and a discharging roller side driving gear attached coaxially to the discharging roller for rotation therewith and having a second number of teeth, wherein when a first meshing frequency defined by multiplication of the first number of teeth and the number of rotations of the fixing roller side driving gear is defined as F1, and a second meshing frequency defined by multiplication of the second number of teeth and the number of rotations of the discharging roller side driving gear is defined as F2, the first meshing frequency F1 and the second meshing frequency F2 are set so as to satisfy the following expression (4):

$$F1>F2 \quad (4).$$

9. The fixing device according to claim 8, wherein when an outer diameter of the fixing roller is defined as DC and an outer diameter of the discharging roller as DD, the outer diameters DC and DD are set so as to satisfy the following expression (5):

$$DC>DD \quad (5).$$

10. An image forming apparatus, comprising:

an image forming section forming an image on a sheet; and a sheet feeding device feeding the sheet to the image forming section, the sheet feeding device including:

a sheet conveying path in which a sheet is conveyed in a predetermined direction;

a first conveying roller pair having a first conveying roller disposed in the sheet conveying path and conveying the sheet in the predetermined direction;

a second conveying roller pair having a second conveying roller disposed downstream of the first conveying roller in the sheet conveying path and conveying the sheet, conveyed from the first conveying roller, in the predetermined direction;

a first driving gear attached coaxially to the first conveying roller for rotation therewith and having a first number of teeth;

a second driving gear attached coaxially to the second conveying roller for rotation therewith and having a second number of teeth; and a drive source driving the first driving gear and the second driving gear, wherein, when an end of the sheet on an upstream side in the predetermined direction is sandwiched by the first conveying roller pair and an end of the sheet on a downstream side in the predetermined direction is sandwiched by the second conveying roller pair, the expression A>B is satisfied, where A is a first meshing frequency defined by multiplication of the first number of teeth and the number of rotations of the first driving gear and B is a second meshing frequency defined by multiplication of the second number of teeth and the number of rotations of the second driving gear.

11. The image forming apparatus according to claim 10, wherein when an outer diameter of the first conveying roller is defined as DA and an outer diameter of the second conveying roller as DB, the outer diameters DA and DB are set so as to satisfy the following expression (2):

$$DA>DB \quad (2).$$

12. The image forming apparatus according to claim 10, wherein:

the first conveying roller includes a first driving roller conveying the sheet in the predetermined direction, and a first driven roller that is disposed to face the first driving roller so as to sandwich the sheet therebetween and is driven to rotate due to the sheet conveyance by the first driving roller, the second conveying roller includes a second driving roller conveying the sheet, conveyed from the first driving roller, in the predetermined direction, and a second driven roller that is disposed to face the second driving roller so as to sandwich the sheet therebetween and is driven to rotate due to the sheet conveyance by the second driving roller, and when a first slip ratio, defined by a ratio between a rotational linear speed obtained when the first driven roller is driven to rotate and a conveyance speed of the sheet at a position of the first driven roller, is defined as SA, and a second slip ratio, defined by a ratio between a rotational linear speed obtained when the second driven roller is driven to rotate and a conveyance speed of the sheet at a position of the second driven roller, is defined as SB, the first slip ratio SA and the second slip ratio SB are set so as to satisfy the following expression (3):

$$SA<SB \quad (3).$$

13. The image forming apparatus according to claim 11, wherein:

the first conveying roller includes a first driving roller having the outer diameter DA and conveying the sheet in the predetermined direction, and a first driven roller that is disposed to face the first driving roller so as to sandwich the sheet therebetween and is driven to rotate due to the sheet conveyance by the first driving roller, the second conveying roller includes a second driving roller having the outer diameter DB and conveying the sheet, conveyed from the first driving roller, in the predetermined direction, and a second driven roller that is disposed to face the second driving roller so as to sandwich the sheet therebetween and is driven to rotate due to the sheet conveyance by the second driving roller, and when a first slip ratio, defined by a ratio between a rotational linear speed obtained when the first driven roller is driven to rotate and a conveyance speed of the sheet at a position of the first driven roller, is defined as SA, and a second slip ratio, defined by a ratio between a rotational linear speed obtained when the second driven roller is driven to rotate and a conveyance speed of the sheet at a position of the second driven roller, is defined as SB, the first slip ratio SA and the second slip ratio SB are set so as to satisfy the following expression (3):

$$SA<SB \quad (3).$$

14. The image forming apparatus according to claim 10, wherein the sheet conveying path has a curved conveying part that is curved between the first conveying roller and the second conveying roller.

15. The image forming apparatus according to claim 10, wherein slidability of the second conveying roller during the sheet conveyance is greater than slidability of the first conveying roller during the sheet conveyance, when the same sheet is conveyed under same conditions.

16. The image forming apparatus according to claim 10, wherein:

the sheet feeding device further includes a sheet storage section storing the sheet and a pickup roller feeding the sheet from the sheet storage section to the first conveying roller, the first conveying roller includes a sheet feeding roller conveying the sheet, conveyed from the pickup roller, to the second conveying roller, and a retard roller that is disposed to face the sheet feeding roller in contact therewith and rotates in the same rotation direction as a rotation direction of the sheet feeding roller to prevent sheet double-feeding, and the first driving gear is attached coaxially to the sheet feeding roller for rotation therewith.

17. An image forming apparatus, comprising:

an image forming section forming a toner image on a sheet; and a fixing device fixing the toner image, formed on the sheet, onto the sheet, the fixing device including:

a sheet discharge path in which a sheet is discharged in a predetermined direction;

a fixing roller disposed in the sheet discharge path and performing fixation to a toner image on the sheet;

a pressing roller disposed to face the fixing roller in contact therewith with the sheet discharge path therebetween and forming a fixing nip portion with the fixing roller;

a discharging roller disposed downstream of the fixing roller in the sheet discharge path and discharging the sheet, subjected to the fixation, in the predetermined direction;

a fixing roller side driving gear attached coaxially to the fixing roller for rotation therewith and having a first number of teeth; and a discharging roller side driving gear attached coaxially to the discharging roller for rotation therewith and having a second number of teeth, wherein when a first meshing frequency defined by multiplication of the first number of teeth and the number of rotations of the fixing roller side driving gear is defined as F1, and a second meshing frequency defined by multiplication of the second number of teeth and the number of rotations of the discharging roller side driving gear is defined as F2, the first meshing frequency F1 and the second meshing frequency F2 are set so as to satisfy the following expression (4):

$$F1>F2 \quad (4).$$

18. The image forming apparatus according to claim 17, wherein when an outer diameter of the fixing roller is defined as DC and an outer diameter of the discharging roller as DD, the outer diameters DC and DD are set so as to satisfy the following expression (5):

$$DC>DD \quad (5).$$

* * * * *